United States Patent [19]

Coors

[11] 3,970,981

[45] July 20, 1976

[54] ELECTRIC SOLENOID STRUCTURE

[75] Inventor: George T. Coors, Tipp City, Ohio

[73] Assignee: Ledex, Inc., Dayton, Ohio

[22] Filed: May 8, 1975

[21] Appl. No.: 575,510

[52] U.S. Cl. ..... 335/266; 335/256; 335/269

[51] Int. Cl.[2] ..... H01F 7/18

[58] Field of Search ..... 335/257, 258, 269, 249, 335/250, 262, 255, 268, 256, 263, 266

[56] References Cited

UNITED STATES PATENTS 3,900,822 8/1975 Hardwick et al. ..... 335/268

*Primary Examiner*—Harold Broome

*Attorney, Agent, or Firm*—Biebel, French & Nauman

[57] ABSTRACT

A solenoid includes a base formed with an external taper and an adjacent hub sleeve also formed with an external taper, the base and hub being joined by an alignment piece of non-magnetic material formed with a pair of internal tapers which are proportioned to mate with the external tapers of the hub and the base. The alignment insert assures and maintains a predetermined concentric coaxial alignment of the hub and base with respect to a common movable armature.

2 Claims, 3 Drawing Figures

ELECTRIC SOLENOID STRUCTURE

BACKGROUND OF THE INVENTION

This invention relates to the structure of electric solenoids and more particularly to electric solenoids of the general type disclosed in U.S. patent application Ser. No. 450,310 filed Mar. 12, 1974, now U.S. Pat. No. 3,900,822, and assigned to the same assignee as this invention. More particularly, the present invention may be considered as an improvement to the structure as shown and described in the above-identified copending U.S. application.

In the copending application, a proportional solenoid is described in which the armature is subject to conditions of possible side-loading in the event of a lack of concentricity between the relatively moving parts, that is between the fixed base and hub on the one hand and the armature on the other hand, and an arrangement is disclosed and claimed by which the armature is supported to assure concentricity of the armature with respect to the base.

Such solenoids are built-up structures in which a hub member is retained in respective alignment primarily by reason of the force exerted by tie bolts extending between the opposite end plates. It is important that the hub be maintained in a coaxial alignment relation to the bases and the armature in the event of shock, vibration, or other external forces.

SUMMARY OF THE INVENTION

The present invention is directed to a solenoid construction of the general type outlined above, in which an alignment piece or insert is formed of non-magnetic material and is positioned between the hub and the base to assure alignment of the axial bore in the hub with that of the base even under severe environmental conditions of shock and vibration. The axially adjacent portions of the hub and the base are provided with external, oppositely-inclined tapers, and an alignment insert is formed with a pair of internal conical tapers which are positioned and proportioned respectively to mate with the external tapers of the hub and the base. The insert piece provides for coaxial alignment of the hub with respect to the base and assures maintenance of this alignment in the event of the application of external forces such as those of shock or vibration. The outside surface of the insert piece forms a cylinder, and in effect, forms a cylindrical extension of the hub in underlying relation to the coil form of the solenoid. In a single-acting solenoid having only a single base, only one of such insert pieces is employed, whereas two such pieces are employed in a double-acting solenoid having opposite base members.

It is accordingly an important object of this invention to provide an improved proportional solenoid construction which assures coaxial alignment of the hub and the base parts even when subjected to shock or other external mechanical forces.

A further object of the invention is the provision of a solenoid including a non-magnetic metal alignment piece formed with oppositely inclined internal tapers which mate with corresponding external tapers formed on the outer surfaces of the hub and the base and which forms, in effect, a mechanical and thermal continuation extending between the hub and the base to assure the maintenance of the concentricity therebetween, and to improve heat conductivity therebetween. The insert piece further increases the effective heat sink capacity of the associated hub and base.

These and other objects and advantages will be apparent from the following description, the accompanying drawings and the appended claims.

DESCRIPTION OF THE PREFERRED EMBODIMENT

Figure 1:
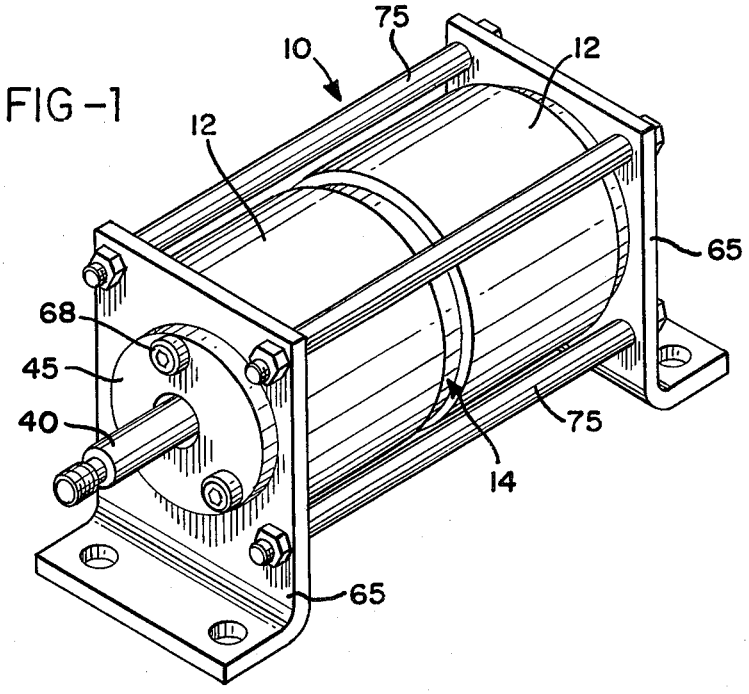
FIG. 1 is a perspective view of a solenoid of the type in which the present invention may be used.
Figure 2:
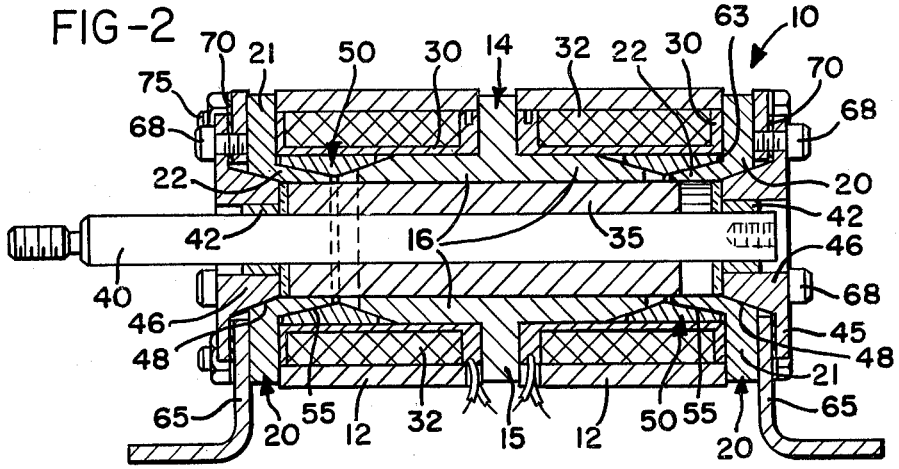
FIG. 2 is a partial sectional view through a proportional, double-acting solenoid employing the invention.

An embodiment of the invention as applied to a double-acting proportional solenoid is illustrated generally at 10 in FIGS. 1–2. This embodiment includes a pair of sleeve-like cylindrical cases 12 which are formed of ferro-magnetic material. The cases 12 are positioned on axially opposite sides of an annular hub 14. The hub 14 is formed with a central radial body or abutment portion 15 and a pair of axially extending sleeve portions 16. The inner adjacent ends of the cases are in direct force transmitting abutment with the adjacent radial faces of the hub portion 15. The hub 14 is also formed of ferro-magnetic material, and is provided with opposite axially extending cylindrical sleeve portions 16 which define an armature-receiving bore or opening therethrough.

In the double-acting embodiment of the solenoid, a pair of identical bases 20 are also formed of ferro-magnetic material and are provided with disc-shaped bodies 21 which have radial inwardly-facing surfaces which are in direct abutment with the outer ends of the cases 12.

Each base terminates in an inner tapered cone-shaped pole portion 22 which is offset from the body 21 inwardly toward the adjacent sleeve portion 16 of the hub. The apex of the pole portion 22 is spaced by an air gap from the terminal end of an adjacent sleeve portion 16. The base 20 at the pole defines an internal cylindrical opening which has substantially the same inside diameter as the opening defined by the sleeve portion 16 of the hub 14, although it is not essential that these inside diameters be exactly the same.

In the double-acting embodiment of the solenoid 10, a pair of electrical coil assemblies are employed which are positioned symmetrically on either side of the radial portion 15 of the hub 14. The electrical coil assemblies each include a generally spool-shaped coil form or bobbin 30 made of non-magnetic material with an inside diameter proportioned to be received over one of the sleeve portions 16 in the axial space between the radial faces of the base and hub. An electrical coil 32 is wound on each bobbin 30.

An axially-extended cylindrical armature 35 is received within the coaxial armature openings formed by the sleeve portions 16 of the hub and the pole portion 22 of the base. The armature is also made of a suitable ferro-magnetic material, and has a length which is slightly greater than the spaced-apart distances of the bases as defined by the pole portions 22, so that when one end of the armature 35 is fully telescoped within one of the conical pole portions 22, the other end is just entering the opposite pole portion at the apex thereof. The sleeve portions 16 of the hub 14 cooperate with the armature 35 to provide a long, non-working air gap.

The armature 35 is mounted for axial movement within the solenoid on a central support shaft 40. The shaft 40 is received within low-friction bearings 42 mounted in identical combined solenoid end walls and bearing housings 45. The bearing housings 45 cooperate with the bases 20 to assure concentricity of the armature with respect to the bases. Ideally a radially constant-clearance air gap is maintained about the armature 35 with respect to the bases and the hub, although a different clearance may be provided between the armature and the bases on the one hand and between the armature and the hub on the other hand.

To maintain base-to-armature concentricity, the housing 45 is provided with an inwardly extending portion 46 which has an outer surface 48 defined by a cone-shaped taper which precisely mates with a matching inside cone-shaped tapered surface formed on each base 20. When the matching surfaces are interfitted, the shaft 40 is held precisely in concentric relation with respect to the cylindrical opening in the tapered base portion 22.

The alignment of hub 14 with respect to the base 20 to maintain a concentricity therebetween is assured by the employment of a non-magnetic insert or alignment piece 50. The piece 50 may be formed of aluminum, brass, stainless steel or other suitable non-magnetic material. The insert or alignment piece 50 is preferably formed of metal to improve the heat sink capacity primarily of the base 20 with which it is in intimate contact.

Figure 3:
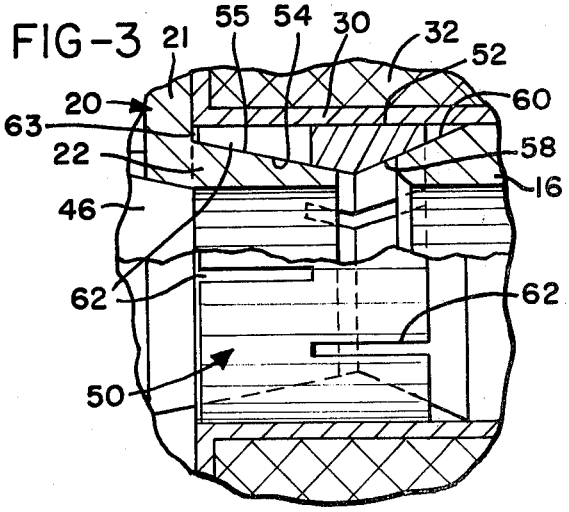
FIG. 3 is an enlarged fragmentary sectional view, partially in elevation, of the alignment insert piece and showing the manner in which it is received on the hub and the base parts of the solenoid of FIG. 2.

The piece 50 is shown in enlarged detail in FIG. 3 and is formed with an outer cylindrical surface 52 which corresponds substantially to the outer diameter of the sleeve portion 16. The piece 50 is further provided with a pair of internal tapers defined by a first tapered surface 54 which is proportioned to mate with the outer tapered surface 55 of the base portion 22, and a second tapered surface 58 which is proportioned to mate with and be received on an external conical taper formed on the adjacent end of the sleeve portion 16.

The taper 55 formed externally on the pole of base portion 22 has the function of providing a predetermined force curve by reason of the selective saturation of the pole material opposite the armature 35, to provide a substantially linear force function in the manner described in the above-identified copending U.S. application, and accordingly the inside mating taper 54 of the piece 50 defines the surface of a cone having the same slope. However, with respect to the hub 14, it is desirable to maintain a substantial thickness of the sleeve portion 16 throughout its length and accordingly its external conical taper 60 is formed with a greater slope, and therefore the mating surface 58 of the alignment piece 50 is formed with a corresponding slope or angle. The piece 50 is formed with a plurality of axially extending slots 62 which extend inwardly from the opposite ends thereof to provide for a limited expansion of the walls, as required, depending upon the precise axial spacing of the hub and base.

The alignment piece 50 thus forms a non-magnetic concentricity maintaining interconnection between the hub and the base. In the double-acting embodiment of FIG. 2, a second piece 50 is used at the opposite end of the hub and aligns this end of the hub with the adjacent base. It is the intention that the alignment piece 50 seat exclusively on the external tapers 55 and 60, which are formed respectively on the base 20 and the hub 14, and to this end, a slight clearance space 63 is normally formed between the piece 50 and the adjacent radial surface of the portion 21 of the base 20, as shown in FIG. 3. In compression at final assembly, it is possible that the axial end of the insert piece 50 may come into contact with the adjacent surface, but in the embodiment shown in FIG. 2, in which two of the alignment inserts are employed, it is generally not possible for both inserts to so come into contact due to the fact that the accumulated spaces 63 are too great. Even if the clearance space 63 at one or the other ends of the solenoid should be eliminated during assembly, it is clear that the primary seating relation exists at the mutually seating conical surface pair 54, 55 and 58, 60, and thus the maintenance of the coaxial alignment between the hub and the base parts is assured.

When the bases 20 and the bearing housings 45 are interfitted as previously described, there is an axial space between each bearing housing and its associated base. Aluminum mounting brackets 65 are received in these spaces, and they are each provided with a central opening through which the conical extended portion 46 of the bearing housings 45 is received. The bearing housings 45 are assembled to the brackets 65 by threaded screws 68. A gasket 70 is interposed between the radial inside wall of the housing 45 and the adjacent flat surface of the bracket 65. Four tie bolts 75 extend externally of the cases 12 and hub between the opposite mounting brackets to retain the entire assembly by urging the mounting brackets tightly into abutment with the outside radial surfaces of the adjacent bases.

The concentric relation of the hub and bases is assured by the alignment pieces 50 and maintained by the tie bolts 75 which apply a compressive force to the bases 20, this compressive force being transmitted through the cases 12 and to the radial portion 15 of the hub 14. The bearing housings 45 may be attached or removed by the screws 68 without disturbing the assembly of the base, cases and hub.

The cone-shaped matching tapers on the piece 50 which engage the corresponding tapered portions of the hub and base assure maintenance of a true concentricity between these parts. It is should be necessary to remove or reassemble the unit, the aligned parts are automatically realigned into proper concentric relation by reason of the mating tapers upon reassembly.

While the form of apparatus herein described constitutes a preferred embodiment of this invention, it is to be understood that the invention is not limited to this precise form of apparatus, and that changes may be made therein without departing from the scope of the invention.

What is claimed is:

1. In a proportional type solenoid having a hub with a cylindrical extending portion and a base having an annular tapered portion, said hub and said base each being provided with a coaxial cylindrical opening therethrough, and means mounting a cylindrical armature for movement within said hub and said base portion, and in which said hub and base are magnetically, axially separated, the improvement for providing and assuring coaxial alignment of said hub and base comprising:

means on said hub cylindrical portion defining an external taper at the end thereof adjacent said base portion, and an annular alignment piece formed of non-magnetic material provided with a pair of internal tapers which are proportioned respectively to mate with the external tapers of siad base and hub portions and having an outside diameter which is substantially coincidental with the outside diameter of said hub, to maintain said hub in coaxial alignment with said base.

2. In a solenoid having a hub with a cylindrical portion and a base with an axially extending portion spaced from said hub portion, including means mounting an armature for movement within said hub and said base portions, the improvement for providing and assuring coaxial alignment of said hub and base comprising:

means on said base portion defining an external taper sloping toward said hub, means on said hub cylindrical portion defining an external taper at the end thereof adjacent said base portion and sloping toward said base, and an annular alignment piece formed of non-magnetic material provided with a pair of internal tapers which are proportioned respectively to mate with the external tapers of said base portion and said hub to maintain said hub in coaxial alignment with said base.

* * * * *